US008875429B1

(12) United States Patent
Ziegler

(10) Patent No.: US 8,875,429 B1
(45) Date of Patent: Nov. 4, 2014

(54) COMBINATION HANG TAG AND KEYCARD

(71) Applicant: Laminex, Inc., Greenwood, SC (US)

(72) Inventor: Karl Allen Ziegler, Greenwood, SC (US)

(73) Assignee: Laminex, Inc., Greenwood, SC (US)

( * ) Notice: Subject to any disclaimer, the term of this patent is extended or adjusted under 35 U.S.C. 154(b) by 0 days.

(21) Appl. No.: 14/057,324

(22) Filed: Oct. 18, 2013

(51) Int. Cl.
*G09F 3/10* (2006.01)
*G09F 3/04* (2006.01)

(52) U.S. Cl.
CPC ..... *G09F 3/04* (2013.01)
USPC ..... 40/673

(58) Field of Classification Search
CPC ..... G09F 3/04
USPC ..... 40/673
See application file for complete search history.

(56) References Cited

U.S. PATENT DOCUMENTS

| | | | | |
|---|---|---|---|---|
| 6,382,676 | B1 * | 5/2002 | Cochran et al. | 283/51 |
| 7,246,459 | B2 | 7/2007 | Lewis | |
| 7,316,088 | B1 | 1/2008 | Lewis | |
| 7,748,602 | B2 * | 7/2010 | Bethke et al. | 229/92.8 |
| D623,190 | S | 9/2010 | Trujillo | |
| 8,002,197 | B1 | 8/2011 | Whitaker | |
| 8,136,283 | B1 | 3/2012 | Lewis | |
| 2003/0106250 | A1 * | 6/2003 | Best et al. | 40/674 |
| 2009/0307950 | A1 | 12/2009 | Coupland | |
| 2011/0315569 | A1 * | 12/2011 | Haag | 206/38 |

* cited by examiner

*Primary Examiner* — Gary Hoge
(74) *Attorney, Agent, or Firm* — Dority & Manning, P.A.

(57) ABSTRACT

A hang tag is generally provided, along with its methods of manufacture and use. In one embodiment, the hang tag includes a tag body and a keyring tab. The tage body generally defines a tag aperture positioned above an information surface, and a slot extends from an edge of the tag body to the tag aperture. The keyring tab is removeably positioned within the tag aperture defined by the tag body, and comprises a tab body defining a keyring aperture.

10 Claims, 5 Drawing Sheets

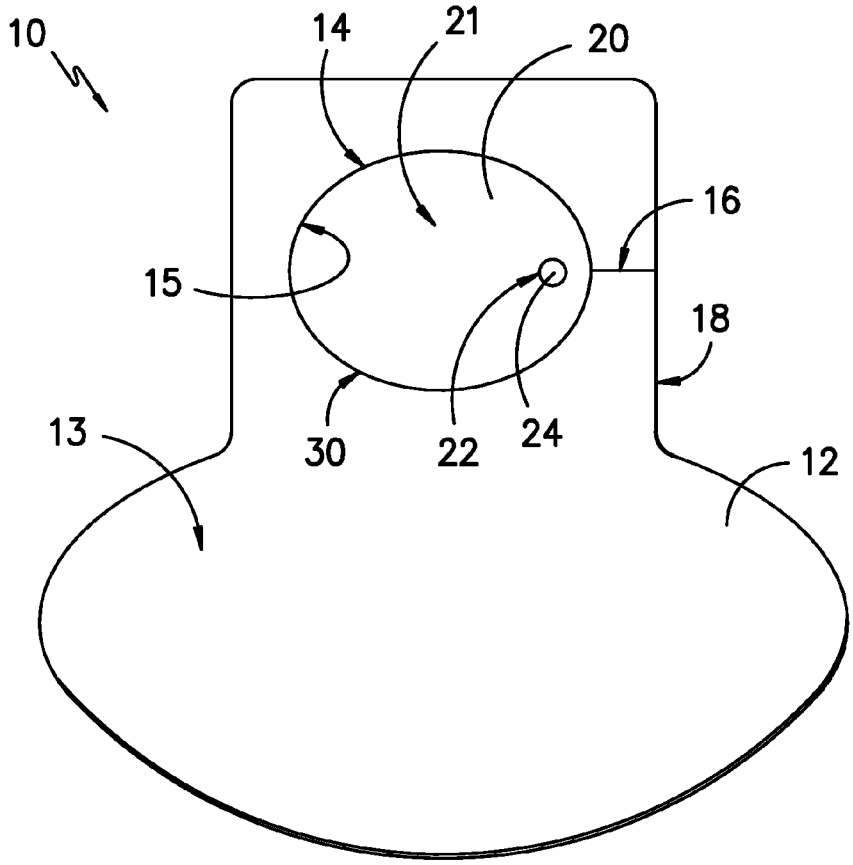
FIG. –1A–

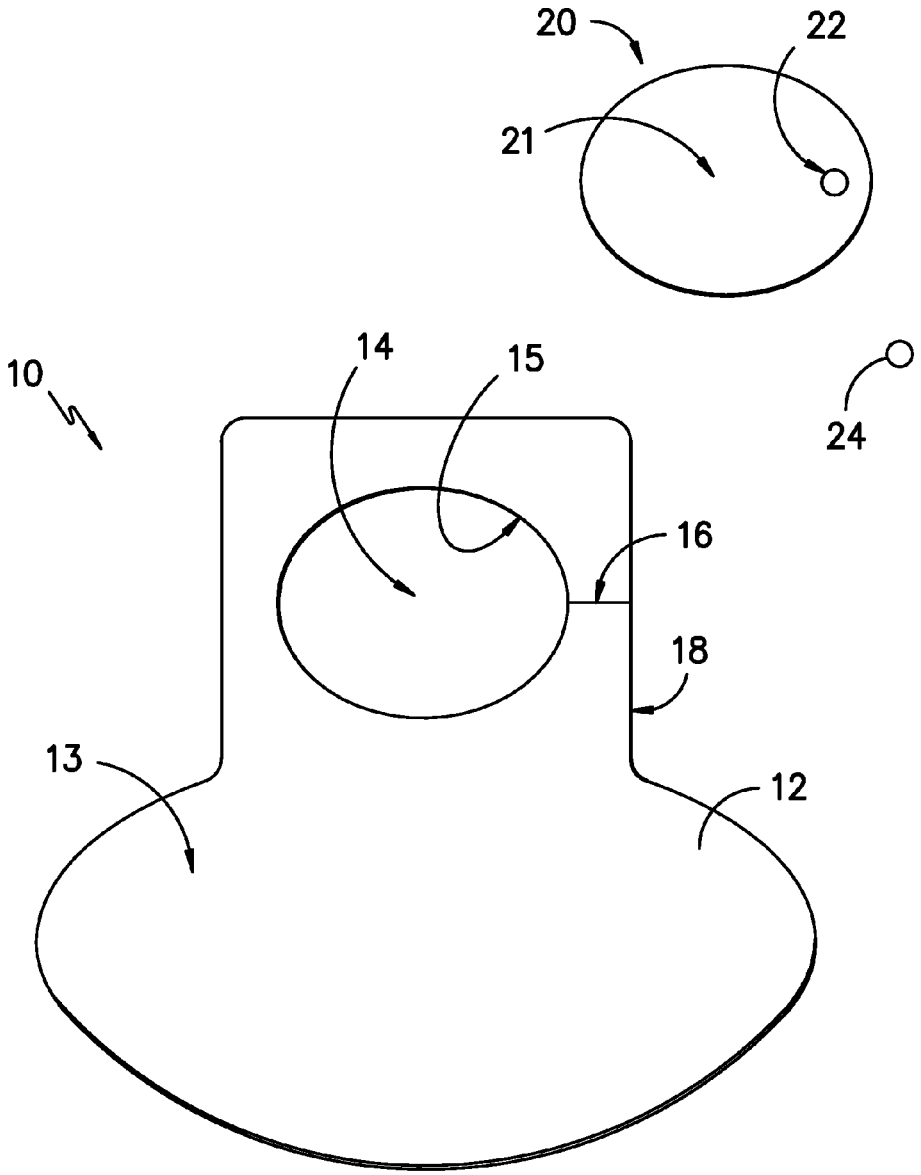
FIG. –1B–

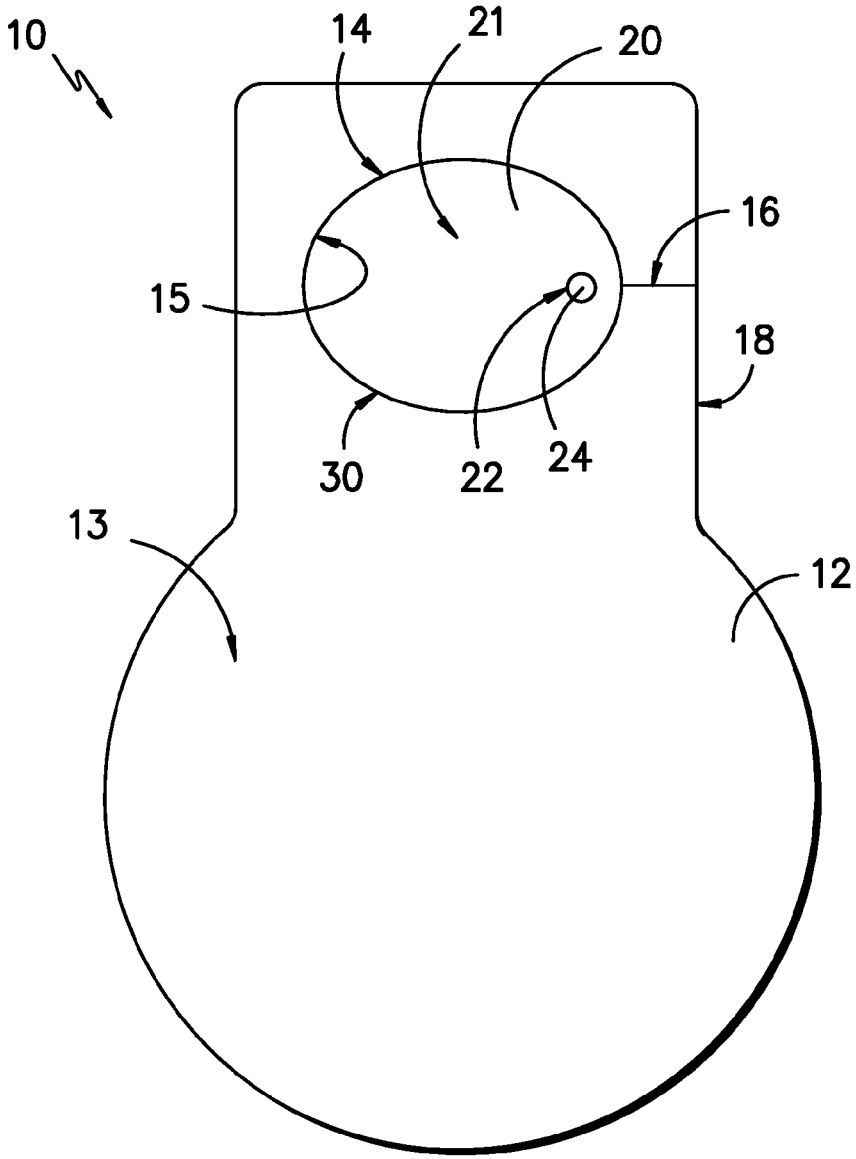
FIG. –2A–

COMBINATION HANG TAG AND KEYCARD

BACKGROUND

Stadiums, arenas, and other event locales deal with large crowds converging to a single location in a relatively small period of time. For example, large numbers of people often gather at such locales for sporting events, concerts, conventions, etc. within a relatively small window of time. As such, parking issues at these locales are often an important part of the event pre-planning and execution.

Many times, parking rights are reserved, and a "parking pass" may be issued to an attendee for parking in a particular parking lot, garage, or even a particular parking space. Such parking passes may be in the form of a hang tag configured to be temporarily suspended from a rearview mirror in an automobile. The event organizers often use such hang tags as a marketing tool, and decorate the hang tag with logos, advertisements, and other information. The use of such advertisements is limited, however, to the rearview mirror in an automobile A need exists to further exploit the scope of marketing available with such hang tags to expand the reach of the marketing.

SUMMARY

Objects and advantages of the invention will be set forth in part in the following description, or may be obvious from the description, or may be learned through practice of the invention.

A hang tag is generally provided, along with its methods of manufacture and use. In one embodiment, the hang tag includes a tag body and a keyring tab. The tage body generally defines a tag aperture positioned above an information surface, and a slot extends from an edge of the tag body to the tag aperture. The keyring tab is removeably positioned within the tag aperture defined by the tag body, and comprises a tab body defining a keyring aperture.

Other features and aspects of the present invention are discussed in greater detail below.

BRIEF DESCRIPTION OF THE DRAWINGS

A full and enabling disclosure of the present invention, including the best mode thereof to one skilled in the art, is set forth more particularly in the remainder of the specification, which includes reference to the accompanying figures, in which:

FIG. 1A shows a general schematic of an exemplary hang tag according to one embodiment of the present invention;

FIG. 1B shows a general schematic of the exemplary hang tag of FIG. 1A with the keyring tab and stub separated from the tag body;

FIG. 2A shows a general schematic of an exemplary hang tag according to one embodiment of the present invention;

Figure 2B:
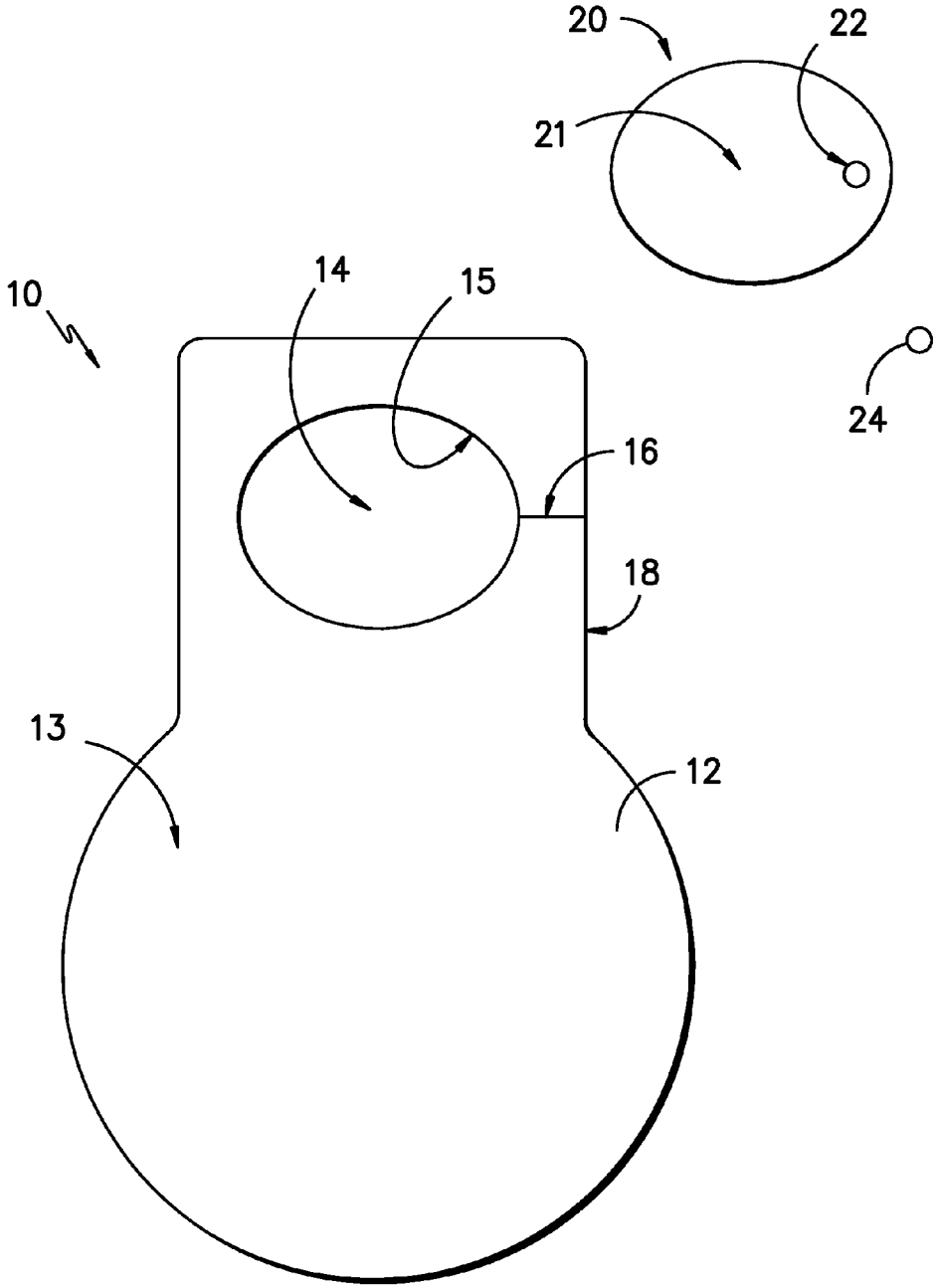
FIG. 2B shows a general schematic of the exemplary hang tag of FIG. 2A with the keyring tab and stub separated from the tag body

Repeat use of reference characters in the present specification and drawings is intended to represent the same or analogous features or elements of the present invention.

DETAILED DESCRIPTION

Reference now will be made to the embodiments of the invention, one or more examples of which are set forth below.

Each example is provided by way of an explanation of the invention, not as a limitation of the invention. In fact, it will be apparent to those skilled in the art that various modifications and variations can be made in the invention without departing from the scope or spirit of the invention. For instance, features illustrated or described as one embodiment can be used on another embodiment to yield still a further embodiment. Thus, it is intended that the present invention cover such modifications and variations as come within the scope of the appended claims and their equivalents. It is to be understood by one of ordinary skill in the art that the present discussion is a description of exemplary embodiments only, and is not intended as limiting the broader aspects of the present invention, which broader aspects are embodied exemplary constructions.

A hang tag is generally provided that can be used as a hang tag, such as a parking pass for hanging on a rear-view mirror of a car. Additionally, upon removal of the keyring tab, the user can attach the keyring tab to their key ring.

Referring to FIGS. 1A and 1B, an exemplary hang tag 10 is generally shown having a tag body 12 that defines a tag aperture 14 positioned above an information surface 13. Generally speaking, the information surface 13 can contain any suitable images/drawings/markings thereon, such as marketing information (e.g., a logo), event information, text information, etc. Additionally, as shown in the embodiments of FIGS. 1A and 1B, the tag body 12 can define any suitable shape (particularly under the aperture 14), such as the football-like shape of FIGS. 1A and 1B. FIGS. 2A and 2B are substantially identical to FIGS. 1A and 1B, but for the shape of the tag body 12 defining a circle (e.g., a basketball or baseball). Of course, other shapes can be utilized for the tag body 12 as desired.

A slot 16 extends from an edge 18 of the tag body 12 to the inner edge 15 defining the tag aperture 14 in the tag body 12. As shown, the slot 16 is a cut extending the entire distance from the outer edge 18 to the inner edge 15. However, in other embodiments, the slot 16 can be a perforation line or other weak linkage therebetween. In use after removal of the keyring tab 20 discussed below, the user can temporarily affix the hang tag 10 onto a rear-view mirror (or other appropriate supporting bar) by accessing the tag aperture 14 via the slot 16.

Figure 3:
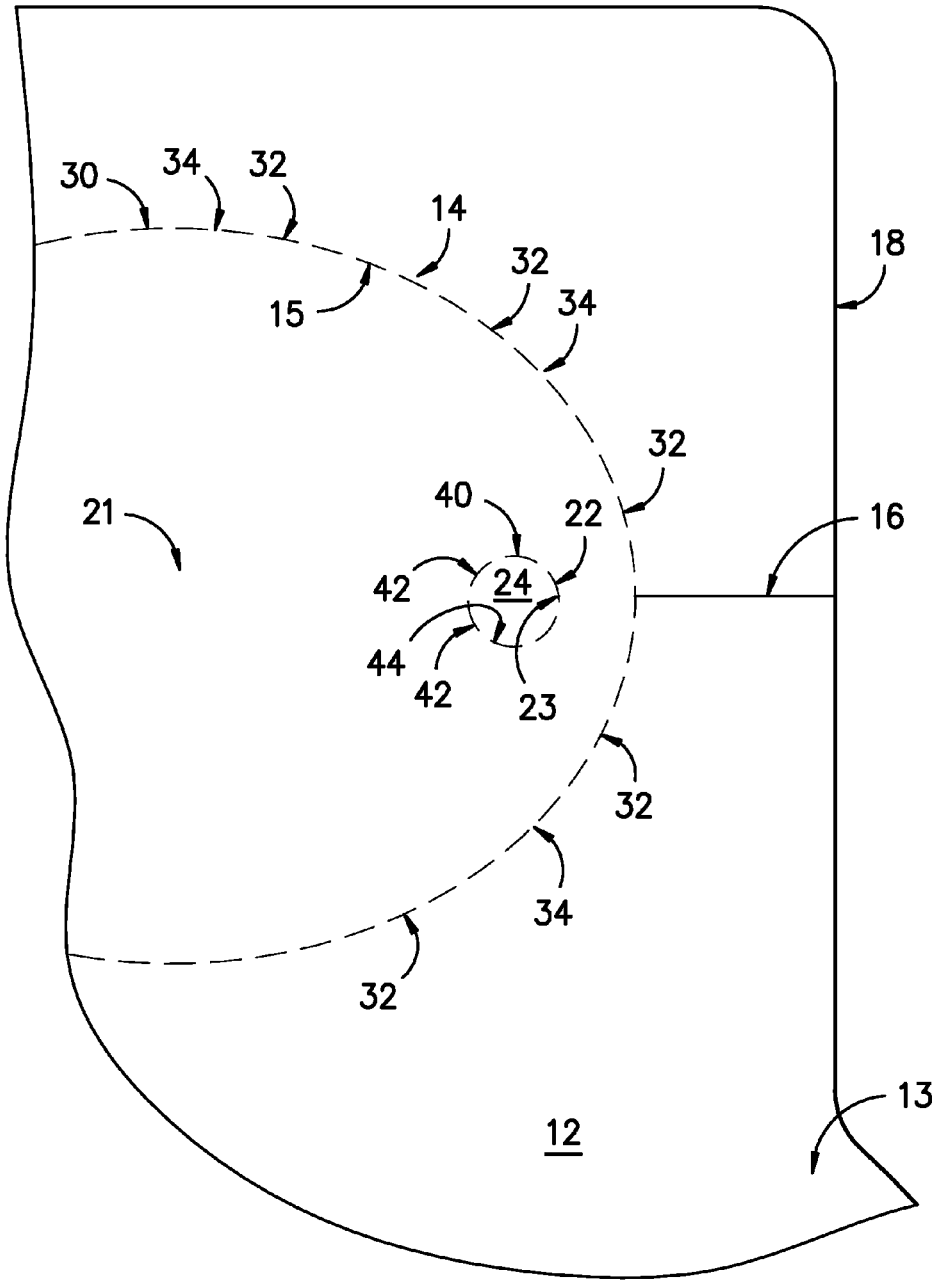
FIG. 3 shows a close-up view of an exemplary hang tag according to one embodiment of the present invention.

A keyring tab 20 is removeably positioned within the tag aperture 14 defined by the tag body 12. Generally, the keyring tab 20 includes a tab body 21 that defines a keyring aperture 22. As best shown in the close-up view of FIG. 3, the keyring tab 20 is, in one embodiment, removeably connected to an inner edge 15 of the tag body 12 that defines the tag aperture 14. For example, the keyring tab 20 can be removeably connected to the edge 15 of the tag body 12 defining the tag aperture 14 via a perforation line 30 configured to release the keyring tab 20 from the edge 15 of the tag body 12 upon application of a force. That is, the perforation line 30 is generally defined by a plurality of spaced apart slots 32. The connecting material 34 positioned between adjacent slots 32 can be torn to remove the keyring tab 20 from the tag body 12 to leave the aperture 14 empty.

Similar to the information surface 13 on the tag body 12, the tab body 21 may also include any suitable images/drawings/markings thereon. In one embodiment, the tab body 21 may include information related to the location of an assigned parking space that is indicated on the information surface 13 on the tag body 12 so as to remind the user of the location of their vehicle.

In one particular embodiment, a stub 24 is removeably positioned within the keyring aperture 22. Upon removal of the stub 24, the keyring tab 20 can be attached to a keyring (not shown) via the keyring aperture 22. As shown, the stub 24 is removeably connected to the inner edge 23 of the keyring tab 20 defining the keyring aperture 22 via a perforation line 40 configured to release the stub 24 from the inner edge 23 upon application of a force. In one embodiment, the perforation line 40 is defines by a plurality of spaced apart slots 42. The connecting material 44 positioned between adjacent slots 42 can be torn to remove the stub 24 from the keyring tab 20 to leave the keyring aperture 22 empty. Upon removal, the stub 24 is discarded.

These and other modifications and variations to the present invention may be practiced by those of ordinary skill in the art, without departing from the spirit and scope of the present invention, which is more particularly set forth in the appended claims. In addition, it should be understood the aspects of the various embodiments may be interchanged both in whole or in part. Furthermore, those of ordinary skill in the art will appreciate that the foregoing description is by way of example only, and is not intended to limit the invention so further described in the appended claims.

What is claimed:

1. A hang tag, comprising:

a tag body defining a tag aperture positioned above an information surface, wherein a slot extends from an edge of the tag body to the tag aperture; and a keyring tab removeably positioned within the tag aperture defined by the tag body, wherein the keyring tab comprises a tab body defining a keyring aperture.

2. The hang tag of claim 1, wherein the keyring tab is removeably connected to an edge of the tag body defining the tag aperture.

3. The hang tag of claim 2, wherein the keyring tab is removeably connected to the edge of the tag body defining the tag aperture via a perforation line configured to release the keyring tab from the edge of the tag body upon application of a force.

4. The hang tag of claim 3, wherein the perforation line is defines by a plurality of spaced apart slots.

5. The hang tag of claim 1, wherein a stub is removeably positioned within the keyring aperture.

6. The hang tag of claim 5, wherein the stub is removeably connected to an inner edge of the tab body defining the keyring aperture.

7. The hang tag of claim 6, wherein the stub is removeably connected to the inner edge of the tab body defining the keyring aperture via a perforation line configured to release the stub from the inner edge of the tab body upon application of a force.

8. The hang tag of claim 7, wherein the perforation line is defines by a plurality of spaced apart slots.

9. The hang tag of claim 1, wherein the tag body is substantially flat.

10. The hang tag of claim 1, wherein the tag body is formed from a laminated paper material.

* * * * *